US006523322B1

(12) United States Patent
Michalski et al.

(10) Patent No.: US 6,523,322 B1
(45) Date of Patent: Feb. 25, 2003

(54) METHOD FOR BUILDING CONSTRUCTION

(75) Inventors: Jacek Michalski, Cracow (PL); Piotr Michalski, Cracow (PL)

(73) Assignee: Agencja Podgorze S.C., Cracow (PL)

( * ) Notice: Subject to any disclaimer, the term of this patent is extended or adjusted under 35 U.S.C. 154(b) by 0 days.

(21) Appl. No.: 09/673,673

(22) PCT Filed: Mar. 23, 1999

(86) PCT No.: PCT/PL99/00010

§ 371 (c)(1),
(2), (4) Date: Oct. 17, 2000

(87) PCT Pub. No.: WO99/55974

PCT Pub. Date: Nov. 4, 1999

(30) Foreign Application Priority Data

Apr. 28, 1998 (PL) ..... 326089

(51) Int. Cl.[7] ..... E04B 1/35

(52) U.S. Cl. ..... 52/745.05; 52/745.16; 52/293.3; 52/236.7; 52/299; 52/481.1

(58) Field of Search ..... 52/236.4, 236.7, 52/236.9, 650.1, 655.1, 745.05, 745.15, 745.16, 481.1, 299, 293.3, 612, 634

(56) References Cited

U.S. PATENT DOCUMENTS

| | | | | | |
|---|---|---|---|---|---|
| RE14,250 | E | * | 1/1917 | Gilbert | 52/293.3 |
| 1,329,706 | A | * | 2/1920 | Gilbert | 52/634 |
| 1,652,415 | A | * | 12/1927 | Schenker | 52/236.7 |
| 1,821,015 | A | * | 9/1931 | Hull | 52/236.6 |
| 2,067,403 | A | * | 1/1937 | Lea | 52/293.3 |
| 2,574,074 | A | * | 11/1951 | Vogel | 52/293.3 |
| 3,751,870 | A | * | 8/1973 | Vesei | 52/656 |
| 4,385,476 | A | * | 5/1983 | Slager | 52/720 |
| 4,918,897 | A | * | 4/1990 | Luedtke | 52/747 |
| 5,113,631 | A | * | 5/1992 | Digirolamo et al. | 52/238.8 |
| 5,479,749 | A | * | 1/1996 | Colasanto et al. | 52/236.9 |
| 5,625,995 | A | * | 5/1997 | Martin | 52/715 |
| 6,301,854 | B1 | * | 10/2001 | Daudet et al. | 52/650.1 |

* cited by examiner

*Primary Examiner*—Lanna Mai
*Assistant Examiner*—Phi Dieu Tran A

(57) ABSTRACT

The subject of the invention is a method house building by using the construction elements prepared outside of the building site. The method consists of preparing the construction elements including beams, studs, and boards outside of the building site. The elements are then mounted onto a foundation at the building site to form a housing structure.

7 Claims, 2 Drawing Sheets

METHOD FOR BUILDING CONSTRUCTION

The subject of an invention is a method of building construction by using the structure elements prepared outside of the construction site.

BACKGROUND OF THE INVENTION

There are known methods for building construction based on light wooden or metal framework. There is known a constructional and technological system based on application of wooden framework. This system is based on the following construction elements:

exterior wall framework elements of fixed dimensions; these elements are strengthened with plywood sheets;

internal and partition wall framework elements, ceiling beams covered with plywood sheets, rafters covered with plywood sheets.

This method of house construction includes: foundation work, framework assembling, outer sheathing, wall covering and finishing-plumbing work.

There is known a method of metal frame construction. This system is based on horizontal thin-walled U-irons and bearing posts made of flange galvanised channel irons. This method of house construction consists in preparing the foundation beneath all bearing walls. The assembling tables are mounted at the construction site or prefabrication plants. On this tables the elements of bearing and partition walls as well as girders are assembled. When assembling the construction elements are cut according to required dimensions. Individual elements are braced with metal stringers. The stiffened elements are lifted with cranes, transported to the construction site and installed. After installing the stringers are removed. This metal frame is covered with plywood sheets or gypsum boards. The known method of house construction has been presented in "Builders Steel Stud Guide", Publication RG-9607/October 1996.

The methods of house construction presented above require that workers who assemble the elements at the site have to be highly qualified. Placing the assembled elements requires heavy building equipment and means of conveyance adapted for transportation of large-size elements. The use of specialised vehicle considerably increases the building costs.

Patent Application nr WO-A-96/35023 addresses some of those issues. The building may be assembled with a minimum number of tools and does not require the employment of well skilled assemblers. In the application an improved building structure and a method of erection have been presented. The structure comprises an elongate track and a plurality of posts rigidly attached to a foundation. Between the posts are disposed a plurality of interlocking foam wall sections, which encapsulate the posts of the wall structure. The wall structure is enforced by the application of braces placed diagonally to the wall structure.

British patent GB-A-807543 presents some improvements relating to buildings. The patent describes the method of assembling the panels of outer skin into the frame so that the edges of all panels fit into channels of the frame. The patent specification describes prefabricated building having a double skin construction of which the building sides are constructed as a rectangular frames each comprising, a base element, a top element an two upright elements. The said upright elements are preferably constructed from extruded aluminium.

Although the both mentioned solutions solve the problem of fast assembling, the process of assembling is time consuming due to application of a large number sophisticated components. There is still the issue of overall cost, which could make that type of house affordable for the people with a low-income.

There is also known from FR-A-2 416 982 a method of erecting a building frame construction comprising studs, beams, wall plates and located over stud-capping beam floor supporting panels preferably made with corrugated steel sheets. These self-carrying panels, which serve as a ceiling as well as floor support, require special equipment for handling.

BRIEF SUMMARY OF THE INVENTION

The main object of invention is to provide a method of erecting a low cost construction, which will reduce the amount of on site labour and will simplify the assembly process. In the method described in this application the all previously mentioned disadvantages are eliminated. By enforcing a simple, low cost, thin walled beams with a help of strengthening inserts it is possible to achieve high endurance and reliability of a building at low price. The design of the construction and the process of assembling are so organised, that all-relevant holes, designating joints are factory made. Only for those joints, where it is impossible to maintain specifications due to instability of materials, the holes are drilled on site.

The method of erecting a building with application of prefabricated construction elements consists of the following steps:

preparing said construction elements outside the building site by cutting them according to required dimensions and providing them with fasteners and holes drilled at required spanning positions, said construction elements comprising sills, beams and U-shaped studs made of metal and stiffening boards transporting said prepared construction elements to the building site, providing foundation for supporting the building, placing said sills having mounting holes on said foundation, drilling holes in said foundation by using said sills as a tracery, providing said studs with L-shaped fasteners at each end, said fasteners being provided with mounting holes, positioning said studs and fasteners on said drilled holes, joining the studs to the sill and the foundation by means. of bolts having expanded sleeves co-operating with said fasteners, joining a stud cap beam and ceiling beam having equally spaced holes to the upper ends of said stud, said ceiling beam having in both ends U-shaped iron strengthening inserts, said inserts being closed on one end equipped with mounting holes on opposite legs, said studs being secured to the stud cupping beams and said ceiling beams via said strengthening inserts, covering on both sides the frame surfaces between said studs and horizontal beams with screw fastened boards and filling the space between the boards with an insulation composition.

installing the next floor sills on-the ceiling beams.

According to this method when the foundation is completed and insulation layers are laid the construction elements previously prepared outside the construction site are erected.

The system of prefabricated sill and stud capping beams with factory drilled holes and the system of studs and ceiling beams equipped with special fasteners enable easy erection with no need to measure the length and span of construction elements. It is necessary to keep the night angle when assembling the first elements. The system of fasteners provides sufficient construction stiffness for erection, thus eliminating the necessity for assembling the whole walls and girders outside of the construction site. This method allows construction to be performed by using the light and easy to transport elements.

By preparing the construction elements outside of the construction site it is possible to reduce the manufacturing costs and improve product repeatability and quality.

The elements can be easy and quickly erected at the construction site, even by the staff of lower qualifications. The method of construction does not require any specialised means of conveyance for handling the large-size elements and building equipment such as cranes.

BRIEF DESCRIPTION OF THE DRAWINGS

The subject of invention is illustrated in figures. The basic construction elements are presented in FIG. 1 and the fasteners and strengthening insert are presented in FIG. 2.

DESCRIPTION OF INVENTION AND PREFERRED EMBODIMENTS

Figure 1:
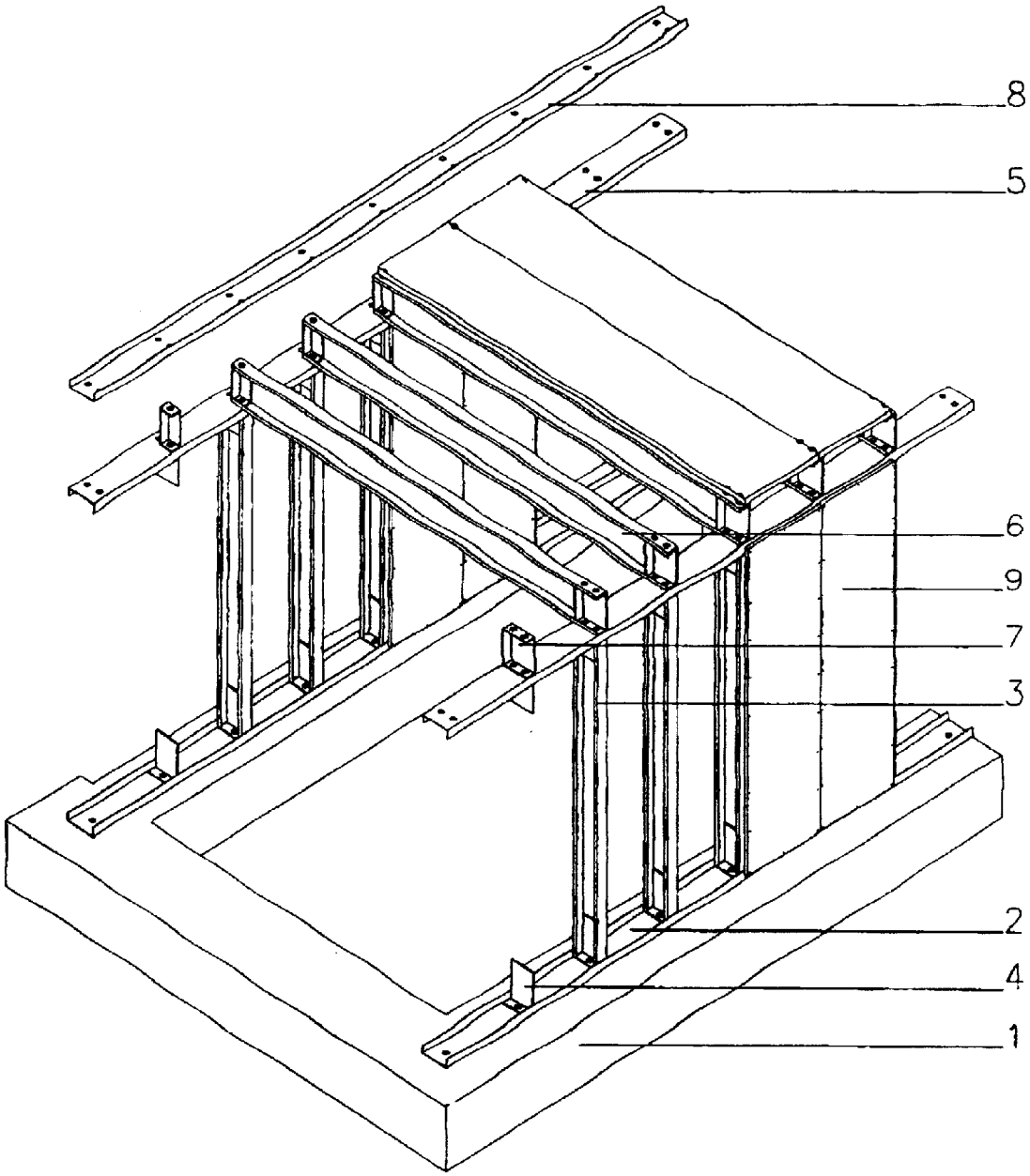
Figure 2:
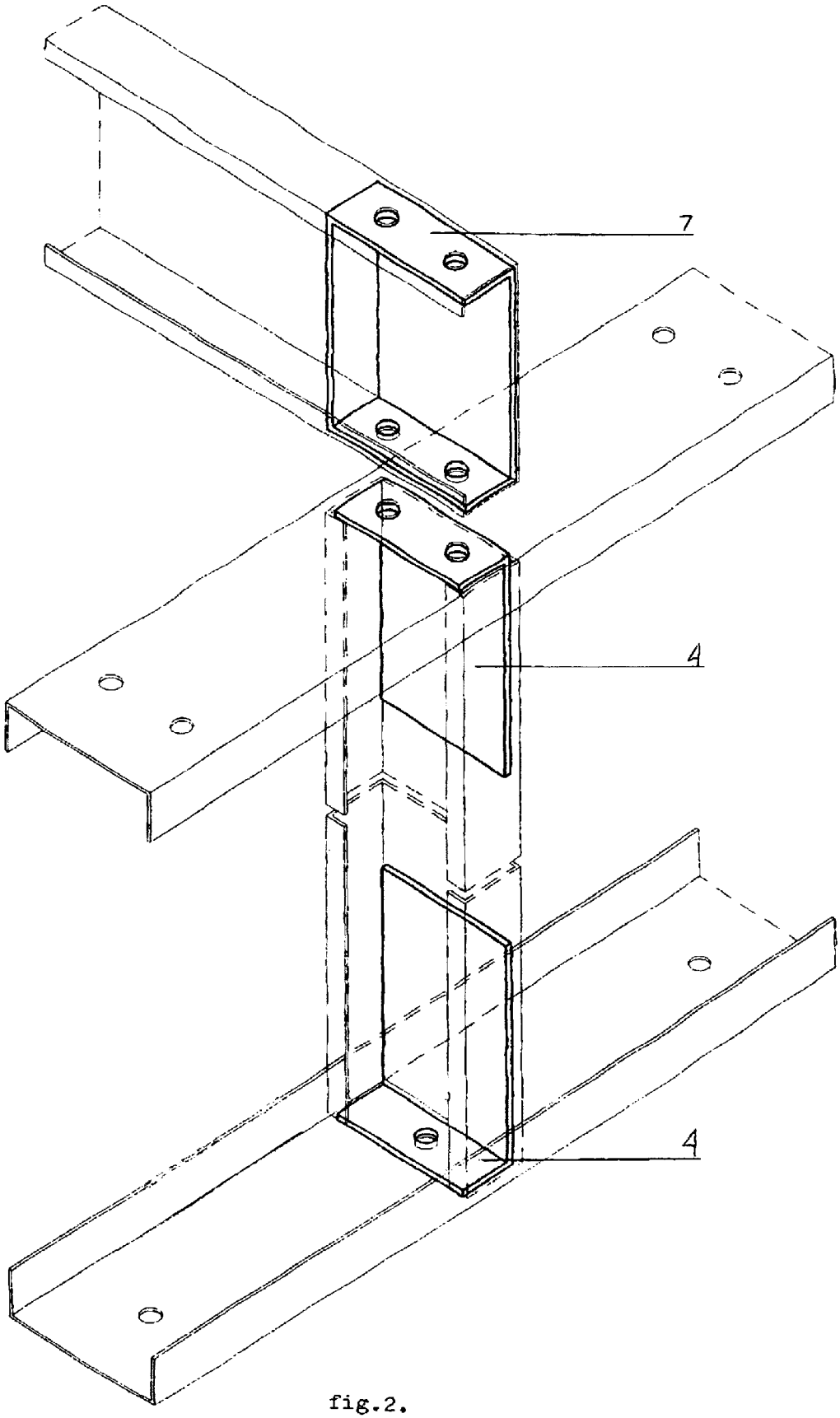

The foundations 1 are made beneath the bearing walls. The lower sill 2 with equally spaced holes is placed on the foundation 1. By using the sill 2 as a tracery the holes are drilled in the foundation 1. The stud 3 with fasteners 4 on both ends are installed in these holes. The studs 3 are joined to the sill 2 and the foundation 1 with the bolts with expand sleeves and fastener 4. The ceiling beams 6 and the stud capping beam also equipped with equally spaced holes are joined to the upper stud ends 3. The ceiling beams 6 have on both ends the strengthening inserts 7 with mounting holes. The studs 3 are joined to the stud capping beams 5 and the ceiling beams 6 by using the strengthening inserts 7. The next floor sill 8 is installed on the ceiling beams 6. The surfaces between the studs 3 and beams 2, 5 are covered with screw fastened boards 9. The boards, which form a floor, are fastened to the ceiling beams 6. Such construction represents single storey. The fastener 4 is made of steel L-shape and has at least one hole in the shorter wall. The strengthening insert 7 protects the ceiling beam end 6 and is also an element for joining the ceiling beam 6 to the stud 3 and the stud capping beam 5. The strengthening insert is made of U-shape, closed on one end and equipped with holes on opposite walls.

What we claim is:

1. A method of constructing a building using construction elements and comprising the steps of:

preparing said construction elements outside the building site by cutting them according to required dimensions and providing them with fasteners and holes drilled at required spanning positions, said construction elements comprising sills (2, 8), beams (6) and U-shaped studs (3) made of metal and stiffening boards (9), transporting said prepared construction elements to the building site, providing foundation (1) for supporting the building, placing said sills (2) having mounting holes on said foundation, drilling holes in said foundation by using said sills (2) as a tracery, providing said studs (3) with L-shaped fasteners at each end, said fasteners being provided with mounting holes, positioning said studs (3) and fasteners (4) on said drilled holes, joining the studs (3) to the sill (2) and the foundation (1) by means of bolts co-operating with said fasteners (4), joining a stud cap beam (5) and ceiling beam (6) having equally spaced holes to the upper ends of said stud (3), said ceiling beam (6) having in both ends U-shaped iron strengthening inserts (7), said inserts being closed on one end equipped with mounting holes on opposite legs, said studs (3) being secured to the stud cupping beams (5) and said ceiling beams (6) via said strengthening inserts (7), covering on both sides the surfaces between said studs (3) and horizontal beams with screw fastened boards (9) and filling the space between the boards (9) with insulation composition.

2. The method of constructing a building according to claim 1 wherein the next floor sills (8) are installed on the ceiling beams (6).

3. The method of constructing a building according to claim 1 wherein the boards (9) are fastened to the ceiling beams (6) and are forming a floor.

4. The method of constructing a building according to claim 3 wherein the construction represents a single story construction.

5. The method of constructing a building according to claim 1 further comprising furnishing fasteners (4) made of steel and with a hole in the shorter wall of the L-shape.

6. The method of constructing a building according to claim 1 further comprising protecting an end of the ceiling beam (6) with the strengthening insert (7); and employing the strengthening insert (7) for joining the ceiling beam (6) to the stud (3) and to the stud cap beam (5).

7. The method of constructing a building according to claim 1 further comprising employing a strengthening insert (7) having a shape of a "U", being closed at one end, and being equipped with holes on opposite walls.

* * * * *